US005860803A

United States Patent [19]

Schindler et al.

[11] Patent Number: 5,860,803

[45] Date of Patent: Jan. 19, 1999

[54] POKER ARRAY

[75] Inventors: Edmund S. Schindler, Fairfield; John P. Guarco, Wolcott, both of Conn.

[73] Assignee: Todd Combustion, Shelton, Conn.

[21] Appl. No.: 725,337

[22] Filed: Oct. 1, 1996

[51] Int. Cl.[6] ..... F23Q 9/00

[52] U.S. Cl. ..... 431/9; 431/10; 431/187; 431/284; 431/285

[58] Field of Search ..... 431/174, 278, 431/284, 285, 8, 9, 10, 187, 188, 181

[56] References Cited

U.S. PATENT DOCUMENTS

| | | | |
|---|---|---|---|
| 3,115,851 | 12/1963 | Cely . | |
| 4,257,763 | 3/1981 | Reed | 431/188 |
| 4,347,052 | 8/1982 | Reed et al. | 431/188 |
| 4,925,387 | 5/1990 | Locanetto et al. | 431/187 |
| 5,154,598 | 10/1992 | Gooderham et al. | 431/188 |
| 5,299,930 | 4/1994 | Weidman | 431/10 |

OTHER PUBLICATIONS

Ca Low $No_x$ Burner Retrofits to 240 MW, 300 MW and 400 MW Oil/Gas Fired Utility Boilers; Final Performance Results and Lessons Learned Brochure, J.J. Kuretski, Jr. et al.

*Primary Examiner*—Carl D. Price
*Attorney, Agent, or Firm*—Hedman, Gibson, & Costigan, P.C.

[57] ABSTRACT

A furnace gas injection apparatus and process for delivering gaseous fuel to a furnace at a compound angle wherein one angle α of the compound angle is directed outwardly from the furnace burner centerline at an angle of between 75° and 120° to a line extending radially from the furnace burner centerline to the gas discharge openings of the gas injection means.

8 Claims, 3 Drawing Sheets

POKER ARRAY

FIELD OF THE INVENTION

This invention relates to an apparatus and method for improving furnace combustion efficiency and reducing the nitrogen oxide ($NO_x$) emissions from a fuel fired burner assembly. More specifically, the invention relates to an improved poker assembly for delivering gaseous fuel to a power plant boiler firebox.

BACKGROUND OF THE INVENTION

Many designs exist for the delivery of fuel to a furnace firebox.

Virtually all designs are intended to enhance combustion efficiency. In addition, tube metal temperatures and other furnace component limitations are considerations in the design of furnace fuel delivery equipment. Recently, carbon monoxide (CO) and $NO_x$ emission associated with furnace fuel combustion have entered into the factors that must be considered when designing furnace fuel delivery systems.

Poker tubes are one means of delivering gaseous fuel to a furnace firebox. Typically, the poker tubes extend from a gas plenum or manifold and protrude into the entry of the furnace firebox. One assembly is an array of poker tubes arranged around the outer periphery of the furnace burner.

Several years ago, Todd Combustion, Shelton, Conn., developed a furnace fuel delivery system that included six poker tubes arranged symmetrically around an air swirler in a furnace burner. As a result of the symmetrical arrangement of the poker tubes, the axial centers of the poker tubes form a circle around the centerline of the furnace burner. Three of the poker tubes are alternately arranged and oriented to deliver gas under pressure directly into the furnace firebox normal to the circle formed by the axial centerlines of the poker tubes. The three remaining poker tubes are arranged alternately between the poker tubes discharging gas normal to the circle formed by the axial centerline of the poker tubes and are oriented to discharge the fuel gas tangentially to the circle formed by the axial centerlines of the poker tubes. The arrangement of the prior art Todd Combustion poker tube assembly is shown in FIG. 3 herein.

The Todd Combustion prior art poker tube system functioned well, but it was believed that improvements could be made. As a result Todd Combustion expended considerable time and money on a project to improve the fuel combustion efficiency and reduce $NO_x$ emission associated with furnace fuel combustion.

SUMMARY OF THE INVENTION

A part of the result of the extensive research and development, an improved furnace gas delivery systems has been developed. An essential element in the improved system is the poker tube assembly.

The improved poker tube assembly comprises three poker tubes arranged symmetrically inside the furnace burner around the periphery of the burner.

Each of the poker tubes is configured similarly to the prior art Todd Combustion poker tubes, however, each is oriented to direct the gas discharged therefrom to the furnace firebox at an angle in the range of 105° to a radial line from the centerline of the furnace burner to the axial center of the poker tube.

DESCRIPTION OF THE DRAWINGS

The subject invention will be better understood when considered with the description of the preferred embodiment and the following drawings wherein.

DESCRIPTION THE PRIOR ART

Figure 1:
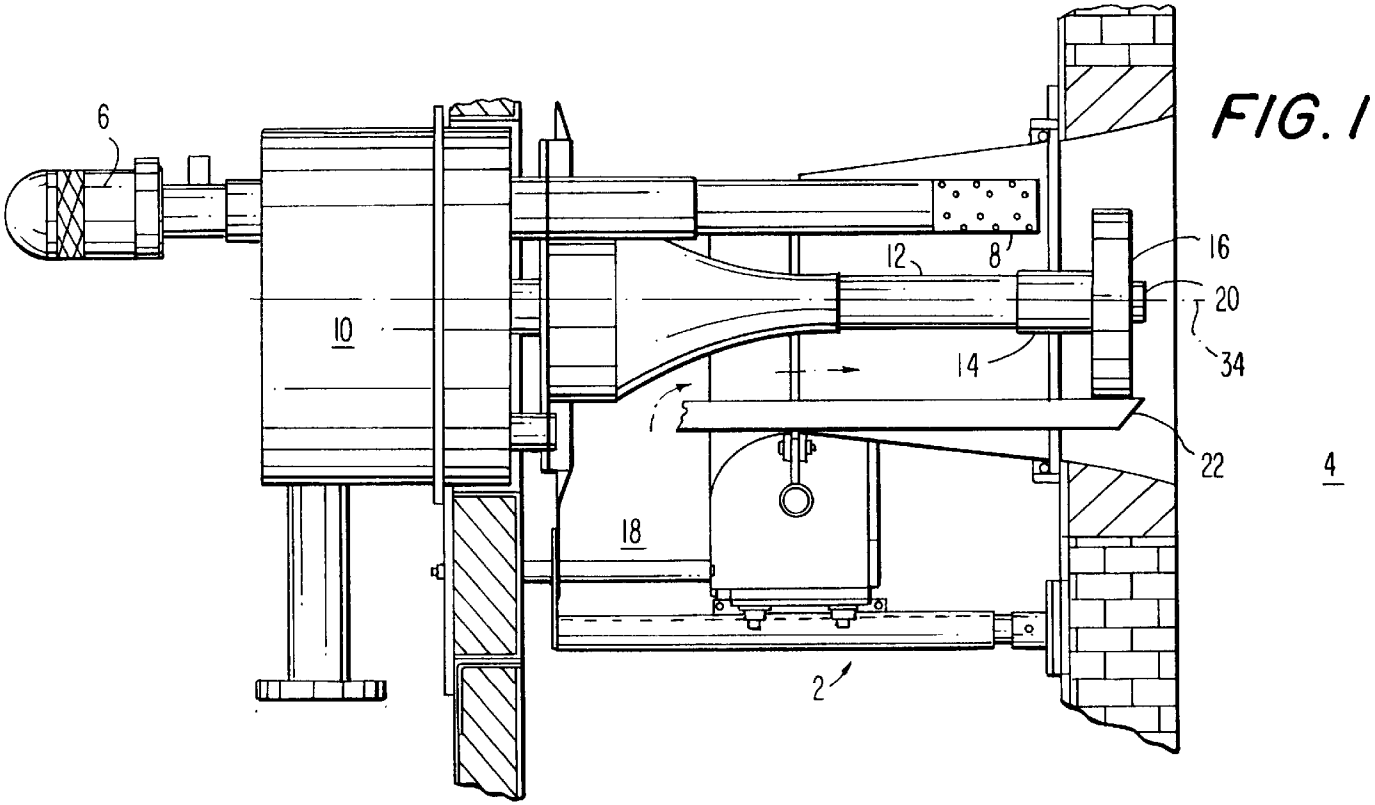
FIG. 1 is a sectional elevational view of a furnace windbox taken through the vertical centerline of the furnace windbox.

The power plant furnace section shown in FIG. 1 is used to illustrate the poker tube assembly of the present invention and the prior art poker tube assembly. The furnace windbox 2 and combustion chamber 4 are shown generally in FIG. 1. A gas igniter 6 and a gas reservoir 10 are located upstream of the windbox 2. The windbox 2, houses the head 8 of the gas igniter 6, a jacket tube 12, swirler hub 14 and swirler 16 for air delivery. A primary/secondary air inlet 18 is also provided for combustion air delivery. An atomizer nozzle 20 is provided for delivery of fuel oil to the combustion chamber 4 and an array of poker tubes 22 (only one of which is shown in FIG. 1) is arranged symmetrically around the swirler 16.

Figure 2:
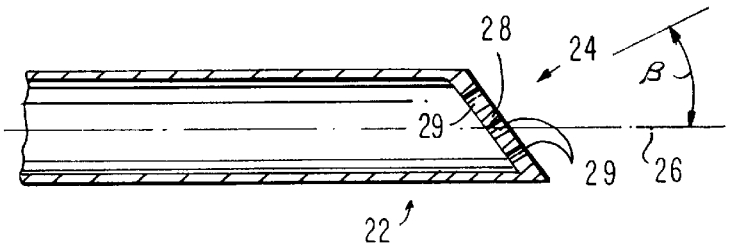
FIG. 2 is a partial sectional elevational view of the poker tube of the present invention.

As seen in FIG. 2, each of the poker tubes 22 is configured with a downstream terminal end 24 formed at an angle $\beta$ in the range of 25° to 35° and preferably of 30° to the centerline 26 of the poker tube 22. As seen in FIG. 2, the poker tube terminal end 24 has a poker face plate 28 having a pattern of holes or slots 29 through which gas under pressure flows to the combustion chamber 4. The holes 29 in the poker face plate 28 are normal to the face plate 28 of the poker tube 22 and direct the gas flow discharging from the poker tube 22 normal to the face plate 28. Typically, the poker tubes 22 are 2 inches in diameter, the thickness of the poker face plate 28 is one-half inch and fourteen holes 29 are formed in the poker face plate 28.

Figure 3:
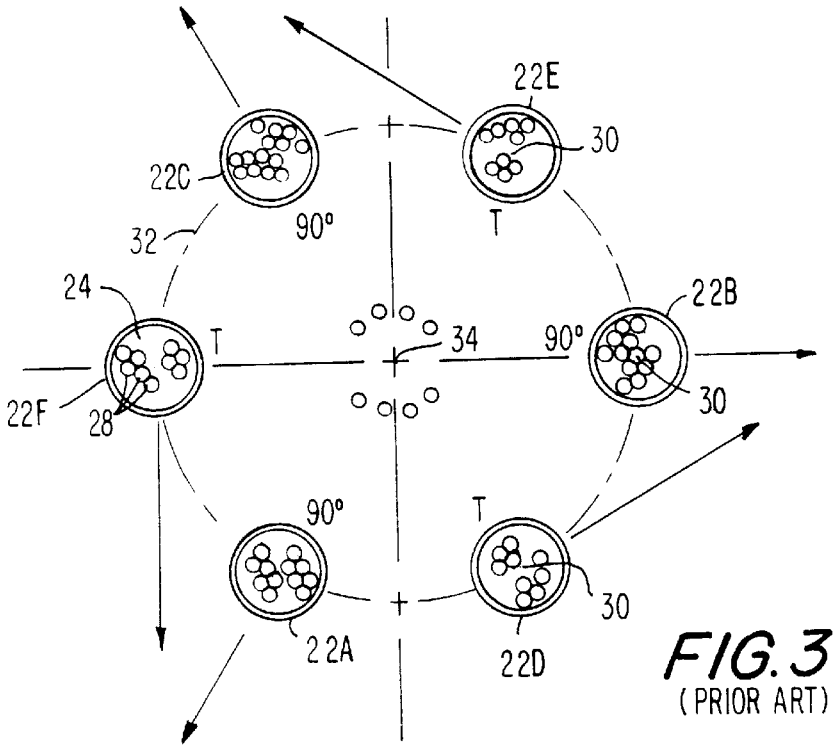
FIG. 3 (PRIOR ART)
FIG. 3 is a front elevational view of the furnace windbox showing diagrammatically the orientation and gas discharge direction of the poker tube assembly of the prior art.

In the prior art, the array of poker tubes comprise six or eight poker tubes symmetrically disposed around the swirler 16 as seen in FIG. 3. The axial centerlines 30 of each poker tube 22 form a circle 32 around the horizontal centerline 34 of the furnace windbox 2. Three of the poker tubes 22A, 22B and 22C disposed 120° from each other on the circle 32 are oriented to direct the gas flow generally radially outwardly at a compound angle from the burner centerline 34. The three remaining poker tubes 22D, 22E and 22F are alternately disposed between the poker tubes 22A, 22B and 22C and are oriented to direct the gas flow at a compound angle tangentially to the circle 32 made by the axial centers 30 of the array of the six poker tubes 22.

Figure 4:
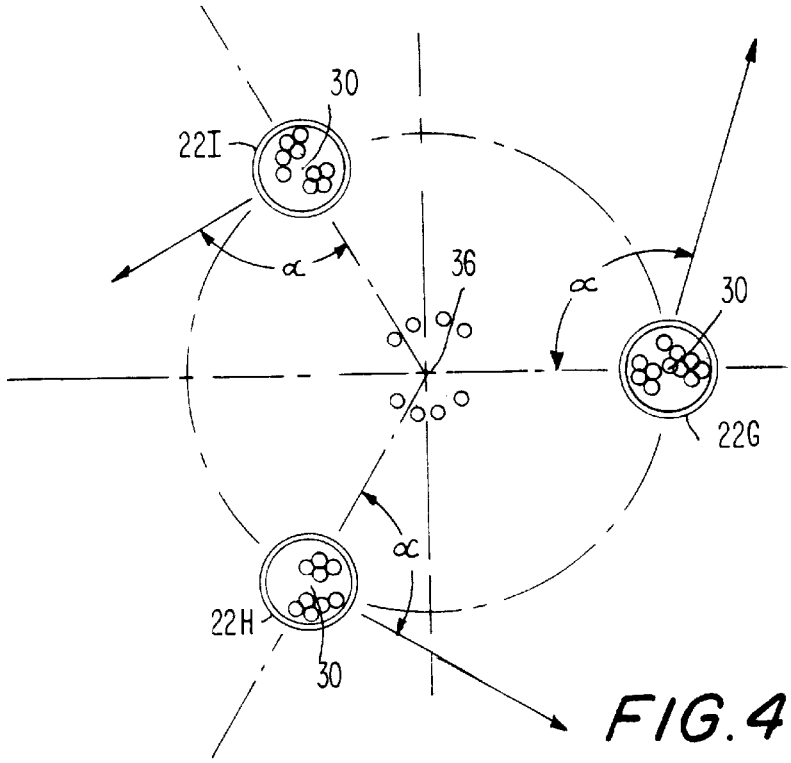
FIG. 4 is a front elevational view of the furnace windbox showing diagrammatically the orientation and gas discharge direction of the poker tube assembly of the subject invention.

In the subject invention seen in FIG. 4, only three poker tubes 22G, 22H and 22I are employed preferably in a symmetrical array around the burner centerline 34. The poker tubes are identical in structural configuration to the poker tubes 22 of the prior art but are arranged to direct the gas flow at an angle $\alpha$ between 75° and 120°, with the preferred angle being 105° to the line 36 made by a radial line from the furnace burner centerline through the axial center line of each poker tube 22G, 22H and 22I.

An illustrative example of the process of the present invention proceeds by the delivery of 148,000 lbs/hr. of combustion air at a pressure of four to eight inches water column above furnace pressure and a temperature of 600° F. to the furnace 2 as primary/secondary air. 200,00 cu. ft./hr. within the range of ambient to natural gases having a BTU content of 1000 per. cu. ft. are delivered at a pressure of 10 psig to the burner.

Significant $NO_x$ reductions, for gaseous fuel firing is achieved as a result of the subject poker assembly.

To improve $NO_x$ emission levels a test program was carried out at the Todd Combustion single-burner, 25 MMBtu/hr test facility in Montreal. The advanced poker arrangement was developed that resulted in a 50% $NO_x$ reduction, on the test rig, as compared to the standard poker arrangement.

The differences between the test facility and actual operational units (including the units preheated combustion air, multiple burner flame interactions and higher combustion intensity) required the development of an enhanced prediction technique to correlate results from the test rig to the actual units. The $NO_x$ at the test facility consisted of a larger percentage of prompt $NO_x$ and a smaller percentage of thermal $NO_x$. A final $NO_x$ level of 0.17 lb/MMBtu was predicted at furnaces identified as A#1&2. The $NO_x$ level measured A#1 was 0.17 lb/MMBtu, reflecting a 35% reduction, and $NO_x$ at A#2 was 0.16 lb/MMBtu, reflecting a 24% reduction.

The advanced poker arrangement of the subject invention was then implemented at furnaces identified as B#1&2 resulting in final $NO_x$ levels of 0.36 lb/MMBtu and 0.56 lb/MMBtu, or reductions of 20% and 14% respectively.

Figure 5:
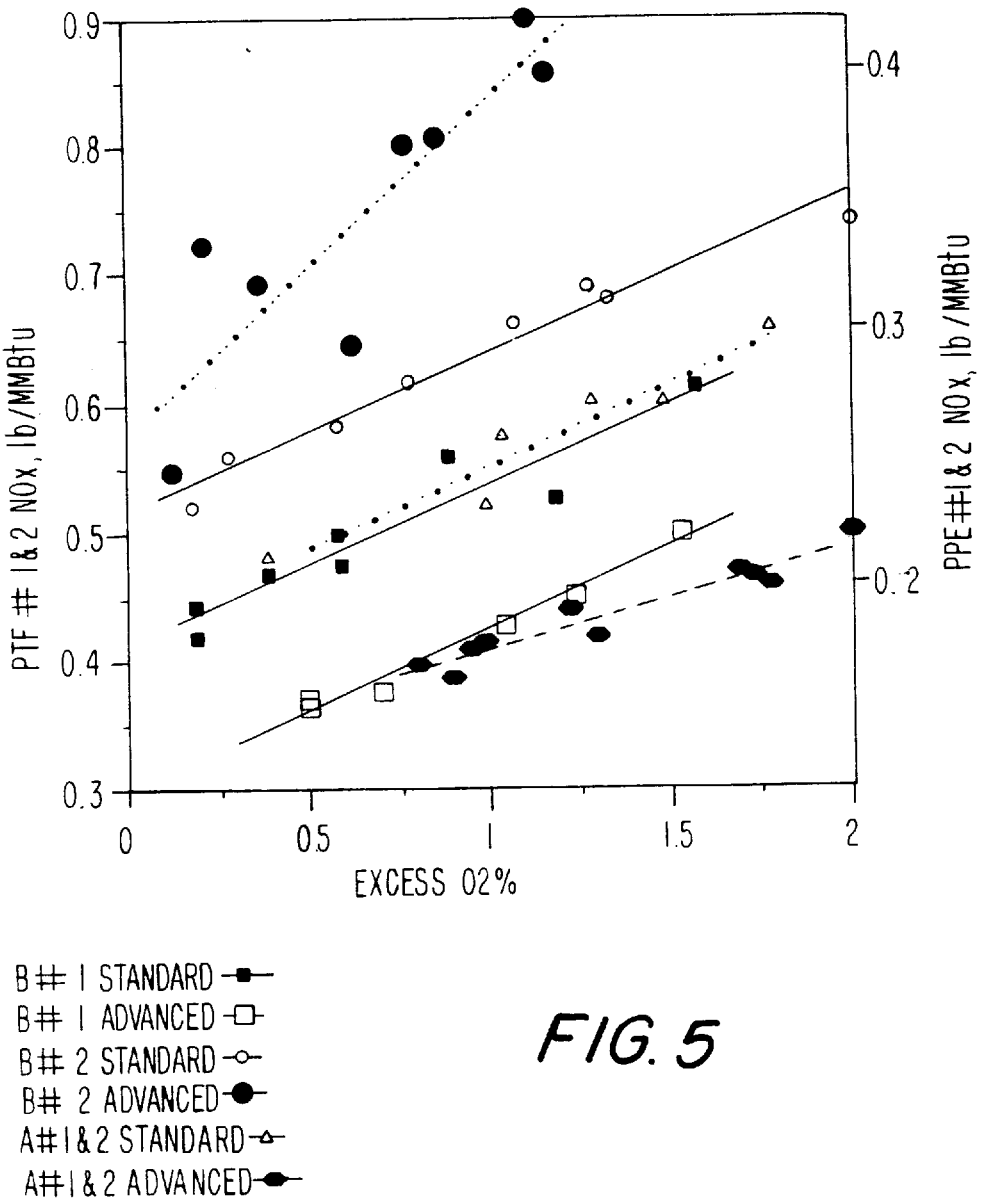
FIG. 5 is a graph illustrating the improved performance of the poker tube assembly of the subject invention over the prior art poker tube assembly.

FIG. 5 shows the effects of the gas fuel poker modifications on $NO_x$ levels at the four furnaces A #1, A #2, B #1 and B #2 wherein standard refers to the prior art poker assembly and Advanced refers to the poker assembly of the subject invention.

In summary, the advanced gas poker arrangement implemented on the four furnaces resulted in improved $NO_x$ reductions between 14% and 35%.

The empirical data generated indicates that the most desirable arrangement to attain the benefits of the invention in a three poker array.

The data also indicate that the benefits of the invention exist with a four poker assembly, but are somewhat diminished and beyond a four poker assembly essentially disappear.

Although the preferred embodiment has been described as employing poker tubes to delver the gas to the furnace, the invention is the angle or compound angle at which the gas is delivered to the furnace. Therefore, any means of gas injection for delivering gas to the furnace such as a gas ring, risers, spuds, etc., are comprehended by the broadest aspects of the invention.

I claim:

1. A process for delivering gaseous fuel to a furnace firebox comprising a burner and a plurality of poker tubes arranged around the outer periphery of said burner all of which direct gaseous fuel outwardly from the centerline of said burner at the same compound angle wherein one angle of the compound angle is an angle $\alpha$ of 105° tangentially to the radius of a circle passing through the axial centers of said poker tubes and a surface on each discharge end of each poker tube is formed at an angle $\beta$ of 30° to the poker tube centerline, said process comprising the steps of delivering gaseous fuel to said poker tubes at a pressure of 10 psi at said burner; and discharging said gaseous fuel from said pokers at the same compound angle to the centerline of said burner, wherein the $NO_x$ generated by combustion of the gaseous fuel is 14 to 50% better than in prior art burners, in which three poker tubes are oriented to direct the gas flow radially outward and three poker tubes are oriented to direct the gas flow tangentially.

2. A process as in claim 1 wherein combustion air and natural gas are delivered to said furnace burner at a ratio of 148,000 lbs/hr. of combustion air at a pressure of four to eight inches water column above furnace pressure at a temperature within the range of ambient to 600° F. to 200,000 cu. ft./hr. of natural gas having a Btu content in the range of 1000 per cu. ft.

3. An apparatus for delivering gas to a furnace comprising a burner, said burner including a plurality of poker tubes all of which direct gaseous fuel outwardly from the centerline of said burner at the same compound angle wherein one angle of the compound angle is an angle $\alpha$ of 105° tangentially to the radius of a circle passing through the axial centers of said poker tubes.

4. An apparatus as in claim 3 wherein the poker tubes are located at the outer periphery of the furnace burner, and comprise three poker tubes arranged symmetrically around the centerline of said burner.

5. An apparatus as in claim 4 wherein a surface on each discharge end of each poker tube is formed at an angle $\beta$ of 25° to 35° to the poker tube centerline.

6. An apparatus as in claim 5 wherein the compound angle is formed by said angle $\beta$ of the poker tube discharge end and the angle $\alpha$ of the orientation of each poker tube.

7. An apparatus as defined in claim 3, wherein said plurality of poker tubes consists of four poker tubes.

8. An apparatus as defined in claim 3, wherein said plurality of poker tubes consists of three poker tubes.

* * * * *